US005702104A

United States Patent [19]

Malek et al.

[11] Patent Number: 5,702,104

[45] Date of Patent: Dec. 30, 1997

[54] METHOD AND APPARATUS FOR PLAYING MIXTURE OF TWENTY-ONE AND BACCARAT USING THREE, FOUR OR FIVE PLAYER CARDS

[75] Inventors: Mehrdad M. Malek, 1306 Daviswood Dr., McLean, Va. 22102; Thomas P. Kadlic; Frank D. Borsenik, both of Las Vegas, Nev.

[73] Assignee: Mehrdad M. Malek, McLean, Va.

[21] Appl. No.: 720,173

[22] Filed: Sep. 25, 1996

[51] Int. Cl.[6] ..... A63F 1/00

[52] U.S. Cl. ..... 273/292

[58] Field of Search ..... 273/292, 303, 273/304, 305, 274

[56] References Cited

U.S. PATENT DOCUMENTS

| | | | |
|---|---|---|---|
| 5,013,049 | 5/1991 | Tomaszewski | 273/292 |
| 5,154,429 | 10/1992 | LeVasseur | 273/292 |
| 5,224,706 | 7/1993 | Bridgeman et al. | 273/292 X |
| 5,265,882 | 11/1993 | Malek | 273/292 |
| 5,288,082 | 2/1994 | Marquez | 273/292 |
| 5,294,128 | 3/1994 | Marquez | 273/292 |
| 5,314,194 | 5/1994 | Wolf | 273/292 |
| 5,328,189 | 7/1994 | Malek | 273/292 |
| 5,395,120 | 3/1995 | Malek | 273/292 |

FOREIGN PATENT DOCUMENTS

| | | | |
|---|---|---|---|
| 9419074 | 9/1994 | WIPO | 273/292 |

*Primary Examiner*—William E. Stoll

*Attorney, Agent, or Firm*—Parkhurst, Wendel & Burr, L.L.P.

[57] ABSTRACT

A method and apparatus for playing a mixture of Twenty-one and Baccarat. Each player initially receives three cards, one for Twenty-one, one for Baccarat, and one common card to be summed with the Twenty-one card and the Baccarat card. The player then has the option of receiving a second Twenty-one card to be summed with the first Twenty-one card and the common card, and a second Baccarat card to be summed with the first Baccarat card and the common card.

19 Claims, 2 Drawing Sheets

METHOD AND APPARATUS FOR PLAYING MIXTURE OF TWENTY-ONE AND BACCARAT USING THREE, FOUR OR FIVE PLAYER CARDS

SUMMARY OF THE INVENTION

There are many card games which can be used for gambling purposes in casinos, but most involve playing a single type of game at any given time. U.S. Pat. No. 5,154,429 discloses a method of playing multiple action Twenty-one, but the play is limited to Twenty-one only.

There is also another casino game known as Pai-Gow Poker (also known as Asian poker). In this game each player plays against the bank (Casino) and each receives seven cards after placing their bets against the bank. Then each player picks up his cards and sets them in two hands consisting of a two card set (one set having five cards, the other set having two cards) according to the rules of Draw Poker. Both hands must be winners against the Casino in order to win the game against the Casino. If one hand wins and the other hand loses it will be a push and the bet will stay for the next round of play.

Another game which combines aspects of two separate games is described in U.S. Pat. No. 5,328,189. This game combines Baccarat and Twenty-One, wherein the players compete against the casino as well as other players. Each player is given four cards to separate into two hands of two cards each. One hand is played as a Twenty-One hand while the other hand is played as a Baccarat hand. The player has the option of placing a second bet to obtain a fifth card, which is summed with the cards from each of the Twenty-One and Baccarat hands.

This game gives the player too much of an advantage over the dealer, and thus it is not attractive for commercial casino play. Since Twenty-One and Baccarat are relatively easy games to play, however, it would be desirable to have a game that combines aspects of each of these games, while maintaining suitable odds for the casino.

SUMMARY OF THE INVENTION

It is an object of the present invention to provide a casino game that combines aspects of Twenty-one and Baccarat, which allows a player to play both games against a dealer simultaneously, while maintaining reasonable odds for the casino.

These and other objects of the present invention will be better understood after reviewing the following detailed description taken in conjunction with the attached drawings.

DETAILED DESCRIPTION OF THE PREFERRED EMBODIMENTS

Figure 1:
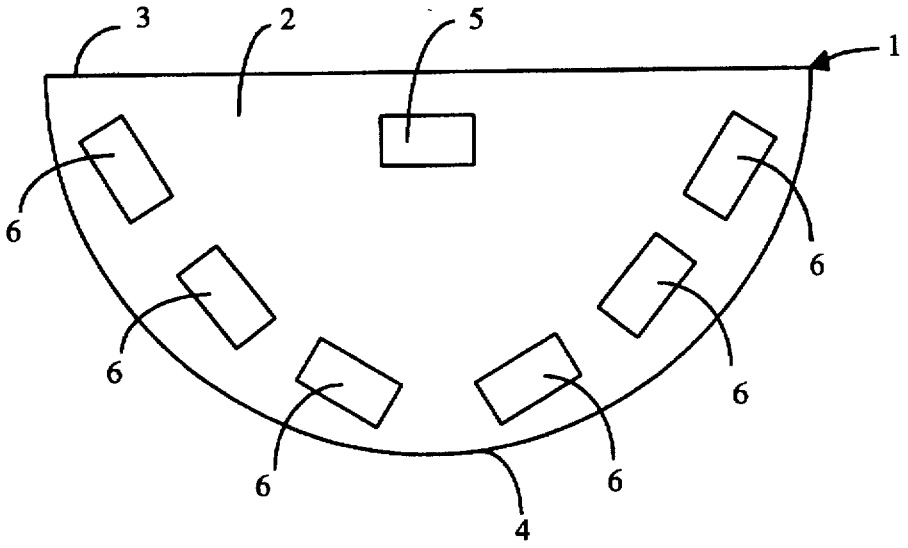
FIG. 1 shows a preferred layout of the apparatus of the present invention which is used in connection with the method of the present invention.

FIG. 1 shows a preferred set-up for the apparatus of the present invention. More specifically FIG. 1 shows a preferred embodiment of the apparatus of the present invention, which includes a table 1 having an upper playing surface 2 formed substantially in the shape of a semicircle. The surface 2 has a substantially linear side 3 along the diameter of the semicircle and a curved side 4 along the circumference of the semicircle. A dealer playing station 5 is arranged substantially midway along the diameter of the semicircular playing surface. Six player playing stations 6 are arranged along the circumference of the semicircular playing surface and are spaced an equal distance apart. The playing table 1 can include any number of player playing stations 6, but preferably this number is limited to six to facilitate monitoring by the dealer.

Figure 2:
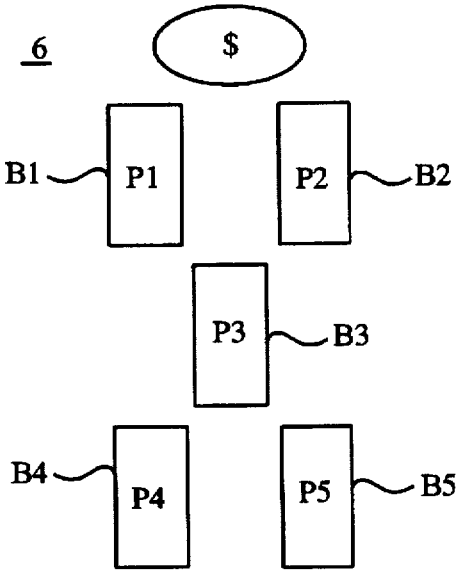
FIG. 2 shows an enlarged view of one embodiment of an individual player playing station in accordance with the apparatus and method of the present invention.

FIG. 2 shows an enlarged view of an individual player playing station 6 of FIG. 1. Each player playing station 6 includes five boxes B1–B5 arranged substantially in the form of an "X". The boxes receive cards P1–P5, placed there by the dealer. Cards P1 and P3, or P1, P3 and P4 are used to play Twenty-one against the dealer and cards P2 and P3, or P2, P3 and P5 are used to play Baccarat against the dealer. A betting area $ is positioned above boxes B1 and B2.

Figure 3:
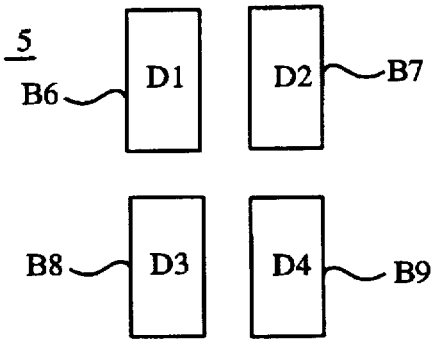
FIG. 3 shows an enlarged view of one embodiment of the dealer playing station in accordance with the apparatus and method of the present invention.

FIG. 3 shows an enlarged view of dealer-playing station 5. The dealer playing station 5 includes two rows of boxes B6–B9, to receive cards D1–D4. Cards D1 and D2 are used to play Twenty-one against the players and cards D3 and D4 are used to play Baccarat against the players.

The present invention is carried out in the following manner. The dealer begins with several (e.g., eight) decks of 52 card Bridge (poker) cards. These cards are placed in a shoe, after shuffling, for distribution during the game. The bank is always held by the casino, as is a standard practice in any commercial establishment. Conventional shuffling and cutting of the cards is carried out by the dealer before commencement of the game.

Prior to any cards being dealt, each player places a bet in the betting area $ of the playing station 6. The dealer then deals three cards face-up to each player, one card P1 in box B1, one card P2 in box B2 and one card P3 in box B3. The Twenty-one hand is played by summing the P1 and P3 cards, while the Baccarat hand is played by summing the P2 and P3 cards. The player cannot change the position of the cards as dealt by the dealer in each of boxes B1–B3.

A preferred embodiment of the game includes an instant winner component. For example, any player whose P1 and P3 cards total 21 and whose P2 and P3 cards total 9 at the same time is an instant winner and is paid immediately by the dealer in accordance with a payoff schedule established by the casino. This instant winner combination of a Twenty-one hand and a 9-point Baccarat hand can be made as follows: P1 card Ace, P2 card 9 and P3 card 10 (K,Q,J or 10); P1 card 10 (K,Q,J, or 10), P2 card 8 and P3 card Ace. The game is then over for each instant winner.

Any remaining players who are not instant winners proceed with the game against the dealer, or if there is no instant winner component, all players would be treated as follows: The dealer deals four cards D1–D4 in his boxes B6–B9, with the D1 card face-up and the D2–D4 cards face-down. If the D1 card is an Ace, the dealer will look at the D2 card to determine if it is a 10 (K,Q,J, or 10). If so, the dealer turns the D2 card face-up and the Twenty-one phase of the game is over for both the dealer and the players.

If the D1 card is not an Ace, the players must then decide to play their P1 and P3 cards against the dealer's Twenty-one hand, noting that the D2 card is still face down, or request a P4 card. The Twenty-one hand of any player requesting a P4 card will comprise the summed total of cards P1, P3 and P4. If a player does not take a P4 card, his Twenty-one hand will comprise the summed total of cards P1 and P3.

After each of the players has either accepted or rejected a P4 card, the dealer turns up card D2 and completes his Twenty-one hand (takes additional cards if necessary) following the house Twenty-one rules. Common rules are that the dealer must stand on 17 points and higher and hit on all hands of 16 points or less. Preferably, the dealer should stand on all hard 17 point or higher hands and hit on all soft 17 point or lower hands.

After the dealer finishes his Twenty-one hand, the game moves to the Baccarat phase.

The dealer looks at cards D3 and D4, which are still face down, to determine if the combined total of those cards is 8 or 9 points (i.e., a "Natural"). If so, the cards are turned face-up and the Baccarat phase of the game is over. If cards D3 and D4 total less than 8 points, the dealer will leave those cards face down and this will signal to the players that they can each take a P5 card, if desired. The Baccarat hand of each player who takes a P5 card will comprise the summed total of cards P2, P3 and P5. If a player does not take a P5 card, his Baccarat hand will comprise the summed total of cards P2 and P3.

After the players have either accepted or refused a P5 card, the dealer turns cards D3 and D4 face up and completes his Baccarat hand according to the house Baccarat rules. Preferably, the dealer should stand on 6 points or higher hands and take a third card with 5 points or lower hands.

Now the dealer compares his Twenty-one hand and Baccarat hand to the Twenty-one hand and Baccarat hand of each player. The player must win both the Twenty-one hand and the Baccarat hand against the dealer to win the bet placed in betting area $. The dealer/casino wins if the player loses both the Twenty-one and Baccarat hands. A push results if the player wins one hand and loses or ties the other hand, or loses one hand and ties the other hand against the dealer.

Figure 4:
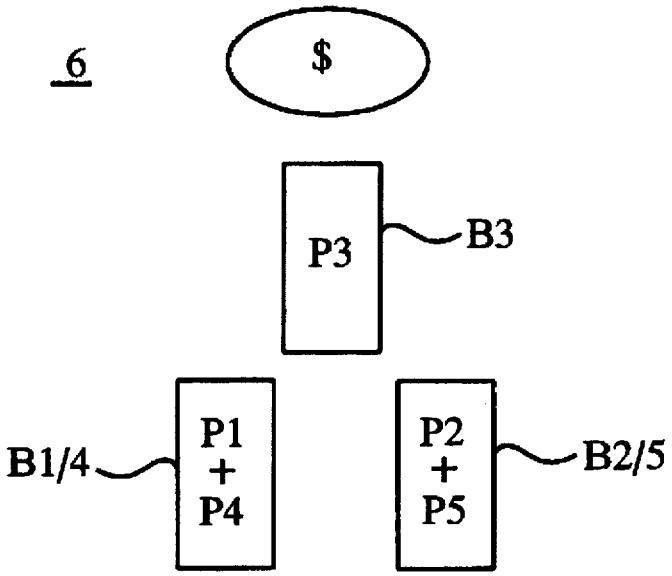
FIG. 4 shows an enlarged view of another embodiment of an individual player playing station in accordance with the apparatus and method of the present invention.

FIG. 4 shows an enlarged view of another embodiment of an individual player playing station 6 of FIG. 1. The player playing station 6 is similar to that of FIG. 2, except that the P1 and P4 cards share one box B1/4 and the P2 and P5 cards share another box B2/5. The P4 card, if selected by the player, will be placed by the dealer to overlap the P1 card and, likewise, the P5 card, if selected by the player, will be placed by the dealer to overlap the P2 card. The P3 card still resides in its own box B3.

Figure 5:
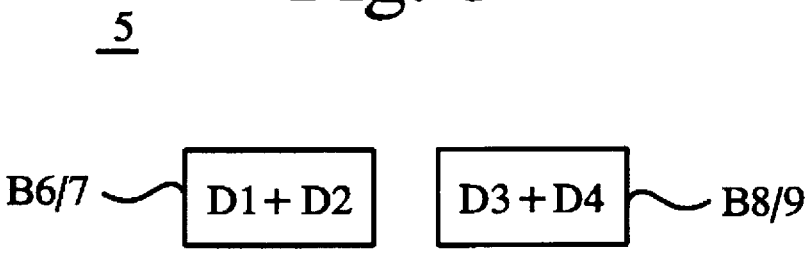
FIG. 5 shows an enlarged view of another embodiment of the dealer playing station in accordance with the apparatus and method of the present invention.

FIG. 5 shows an enlarged view of another embodiment of dealer-playing station 5. The dealer playing station 5 includes two boxes B6/7 and B8/9. Cards D1 and D2 are placed in box B6/7 and used to play Twenty-one against the players and cards D3 and D4 are placed in box B8/9 and used to play Baccarat against the players.

The present invention provides a game which combines aspects of Twenty-one and Baccarat, which maintain reasonable odds for the casino. The game is very easy to learn (for new players) and play (for experienced players). The game can also be implemented with very little training time for dealers and very little experimentation time for players. The game also presents a challenge for players in that they must establish a strategy with regard to whether or not to take the P4 and P5 cards based on the face up D1 card of the dealer's hand and the face up P1–P3 cards of the other players' hands.

Although the present invention has been described above in detail, it is not limited to the specific embodiments described herein. Various modifications and additions may be made and will be apparent to those skilled in the art. For example, the present invention could be easily adapted for electronic play or as a home board game in the same manner that Twenty-one and other popular games have been adapted in the past. Accordingly, the invention should not be limited to the foregoing description but rather should be defined only by the following claims.

What is claimed is:

1. A method of playing a mixture of Twenty-one and Baccarat against a dealer, comprising:

dealing three cards, P1, P2 and P3, face-up to at least one player;

dealing a first set of two cards, D1 and D2, to the dealer, the D1 card face-up and the D2 card face-down;

dealing a second set of two cards, D3 and D4, to the dealer, both face down;

offering a fourth card, P4, to the player;

turning the D2 card face-up and completing the dealer's Twenty-one hand using at least the D1 and D2 cards;

offering a fifth card, P5, to the player;

turning the D3 and D4 cards face-up and completing the dealer's Baccarat hand using at least the D3 and D4 cards; and comparing the summed total of the cards in the dealer's Twenty-one hand to the summed total of the player's P1 and P3 cards or P1, P3 and P4 cards; and comparing the summed total of the cards in the dealer's Baccarat hand to the summed total of the player's P2 and P3 cards or P2, P3 and P5 cards.

2. The method of claim 1, wherein the P1, P2 and P3 cards of the player are arranged by the dealer in a predetermined order.

3. The method of claim 1, wherein the players can take a P4 card only if the summed total of the D1 and D2 cards is less than 21.

4. The method of claim 1, wherein the players can take a P5 card only if the summed total of the D3 and D4 cards is less than 8.

5. The method of claim 1, wherein all cards are dealt from a common deck and the Twenty-one and Baccarat hands of the dealer are completed using additional cards from the common deck.

6. The method of claim 1, further comprising the steps of:

collecting wagered bets from all players whose Twenty-one and Baccarat hands are less than those of the dealer; and paying wagered bets to all players whose Twenty-one and Baccarat hands are more than those of the dealer.

7. A method of playing a mixture of Twenty-one and Baccarat against a dealer, comprising:

providing at least one player playing station having a row of two boxes and a third box positioned proximate the row of two boxes;

dealing two cards, P1 and P2, face-up in the row of two boxes and a third card, P3, face-up in the third box;

providing a dealer playing station having two boxes;

dealing a first set of two cards, D1 and D2, in the first box in the dealer playing station, the D1 card face-up;

dealing a second set of two cards, D3 and D4, in the second box in the dealer playing station;

offering a fourth card, P4, to the player to be placed proximate one of the P1 and P2 cards in the player playing station;

turning the D2 card face-up and completing the dealer's Twenty-one hand using at least the D1 and D2 cards;

offering a fifth card, P5, to the player to be placed proximate the other one of the P1 and P2 cards in the player playing station;

turning the D3 and D4 cards face-up and completing the dealer's Baccarat hand using at least the D3 and D4 cards; and comparing the summed total of the cards in the dealer's Twenty-one hand to the summed total of the player's P1 and P3 cards or P1, P3 and P4 cards; and comparing the summed total of the cards in the dealer's Baccarat hand to the summed total of the player's P2 and P3 cards or P2, P3 and P5 cards.

8. The method of claim 7, wherein the P1, P2 and P3 cards of the player are arranged by the dealer in a predetermined order.

9. The method of claim 7, wherein the players can take a P4 card only if the summed total of the D1 and D2 cards is less than 21.

10. The method of claim 7, wherein the players can take a P5 card only if the summed total of the D3 and D4 cards is less than 8.

11. The method of claim 7, wherein all cards are dealt from a common deck and the Twenty-one and Baccarat hands of the dealer are completed using additional cards from the common deck.

12. The method of claim 7, further comprising the steps of:

collecting wagered bets from all players whose Twenty-one and Baccarat hands are less than those of the dealer; and paying wagered bets to all players whose Twenty-one and Baccarat hands are more than those of the dealer.

13. A method of playing a mixture of Twenty-one and Baccarat against a dealer, comprising:

dealing a Twenty-one card, a Baccarat card and a common card to at least one player;

dealing at least two Twenty-one cards and at least two Baccarat cards to the dealer;

comparing the summed total of the dealer's Twenty-one cards to the summed total of the player's Twenty-one card and common card; and comparing the summed total of the dealer's Baccarat cards to the summed total of the player's Baccarat card and common card.

14. The method of claim 13, wherein the player's cards are arranged by the dealer in a predetermined order.

15. The method of claim 13, further comprising dealing a fourth card to the player, dealing additional cards to the dealer to complete his Twenty-one hand, and comparing the summed total of the dealer's Twenty-one cards to the summed total of the player's Twenty-one card, common card and fourth card.

16. The method of claim 15, wherein the player can take a fourth card only if the summed total of the dealer's initial Twenty-one cards is less than 21.

17. The method of claim 13, further comprising dealing a fifth card to the player, dealing additional cards to the dealer to complete his Baccarat hand, and comparing the summed total of the dealer's Baccarat cards to the summed total of the player's Baccarat card, common card and fifth card.

18. The method of claim 17, wherein the player can take a fifth card only if the summed total of the dealer's initial Baccarat cards is less than 8.

19. The method of claim 13, further comprising the steps of:

collecting wagered bets from all players whose Twenty-one and Baccarat hands are less than those of the dealer; and paying wagered bets to all players whose Twenty-one and Baccarat hands are more than those of the dealer.

* * * * *